US011781267B2

(12) United States Patent
Loccufier

(10) Patent No.: US 11,781,267 B2
(45) **Date of Patent: *Oct. 10, 2023**

(54) METHODS FOR MANUFACTURING PRINTED TEXTILES

(71) Applicant: AGFA NV, Mortsel (BE)

(72) Inventor: Johan Loccufier, Mortsel (BE)

(73) Assignee: AGFA NV, Mortsel (BE)

( * ) Notice: Subject to any disclaimer, the term of this patent is extended or adjusted under 35 U.S.C. 154(b) by 747 days.

This patent is subject to a terminal disclaimer.

(21) Appl. No.: 15/303,619

(22) PCT Filed: Apr. 9, 2015

(86) PCT No.: PCT/EP2015/057672

§ 371 (c)(1),
(2) Date: Oct. 12, 2016

(87) PCT Pub. No.: WO2015/158592

PCT Pub. Date: Oct. 22, 2015

(65) Prior Publication Data

US 2017/0218565 A1 Aug. 3, 2017

(30) Foreign Application Priority Data

Apr. 15, 2014 (EP) ..... 14164670

(51) Int. Cl.
*D06P 5/30* (2006.01)
*D06P 1/16* (2006.01)
(Continued)

(52) U.S. Cl.
CPC ..... *D06P 5/30* (2013.01); *D06P 1/16* (2013.01); *D06P 1/18* (2013.01); *D06P 1/44* (2013.01); *D06P 1/54* (2013.01)

(58) Field of Classification Search
CPC .... B41M 5/52; D06P 5/30; D06P 1/44; D06P 1/18; D06P 1/54; D06P 1/16
See application file for complete search history.

(56) References Cited

U.S. PATENT DOCUMENTS 4,741,932 A * 5/1988 Ichimura ..... C09D 133/066 427/407.1
5,082,757 A * 1/1992 Keoshkerian ..... G03G 9/09328 428/402.24
(Continued)

FOREIGN PATENT DOCUMENTS

CN 107499007 A * 12/2017
EP 0 927 787 A2 7/1999
(Continued)

OTHER PUBLICATIONS

ESPACENET English Language translation of CN107499007A, pp. 1-5 (Year: 2017).*
(Continued)

*Primary Examiner* — Gregory R Delcotto
*Assistant Examiner* — Preeti Kumar
(74) *Attorney, Agent, or Firm* — Leydig, Voit & Mayer, Ltd.

(57) ABSTRACT

A method for manufacturing printed textiles includes the steps of: a) inkjet printing an image onto a textile substrate with one or more inkjet inks including an aqueous medium and capsules composed of a polymeric shell surrounding a core which contains one or more thermally curable compounds; and b) thermally fixing the inkjet printed image. Inkjet printed textiles contain a printed image on a textile substrate wherein pigments and/or disperse dyes are at least partially encapsulated by polymeric shell material from capsules composed of a polymeric shell surrounding a core.

14 Claims, 1 Drawing Sheet

(51) Int. Cl.

| | |
|---|---|
| ***D06P 1/44*** | (2006.01) |
| ***D06P 1/18*** | (2006.01) |
| ***D06P 1/54*** | (2006.01) |

(56) References Cited

U.S. PATENT DOCUMENTS

| | | | | |
|---|---|---|---|---|
| 5,488,907 | A | 2/1996 | Xu et al. | |
| 5,853,861 | A * | 12/1998 | Held | D06P 5/30 428/207 |
| 6,417,249 | B1 * | 7/2002 | Nguyen | C08F 220/18 523/201 |
| 6,521,342 | B1 * | 2/2003 | Hutter | B41M 5/52 428/407 |
| 9,920,211 | B2 * | 3/2018 | Loccufier | C09D 11/328 |
| 10,066,113 | B2 * | 9/2018 | Loccufier | B01J 13/06 |
| 11,254,831 | B2 * | 2/2022 | Loccufier | C09D 11/38 |
| 2001/0038408 | A1 * | 11/2001 | Codos | B41J 2/01 347/102 |
| 2002/0128348 | A1 * | 9/2002 | Palmer | C09D 11/32 523/160 |
| 2002/0193464 | A1 * | 12/2002 | Erdtmann | C09D 11/30 523/160 |
| 2009/0227711 | A1 | 9/2009 | Carlini et al. | |
| 2012/0092428 | A1 * | 4/2012 | Ganapathiappan | C09B 7/00 347/102 |
| 2012/0120146 | A1 | 5/2012 | Coggan et al. | |
| 2014/0002556 | A1 * | 1/2014 | Sato | C09D 11/30 524/265 |

FOREIGN PATENT DOCUMENTS

| | | | |
|---|---|---|---|
| JP | 2004-075759 | A | 3/2004 |
| JP | 2009-203406 | A | 9/2009 |

OTHER PUBLICATIONS

ESPACENET English Language translation of abstractor CN107499007A, p. 1. (Year: 2017).*

Official Communication issued in International Patent Application No. PCT/EP2015/057672, dated May 26, 2015.

Kakihana et al., "Chelating of Titanium by Lactic Acid in the Water-Soluble Diammonium Tris(2-hydroxypropionato)titanate(IV)," *Inorg. Chem.*, 43(15): 4546-4548 (2004).

* cited by examiner

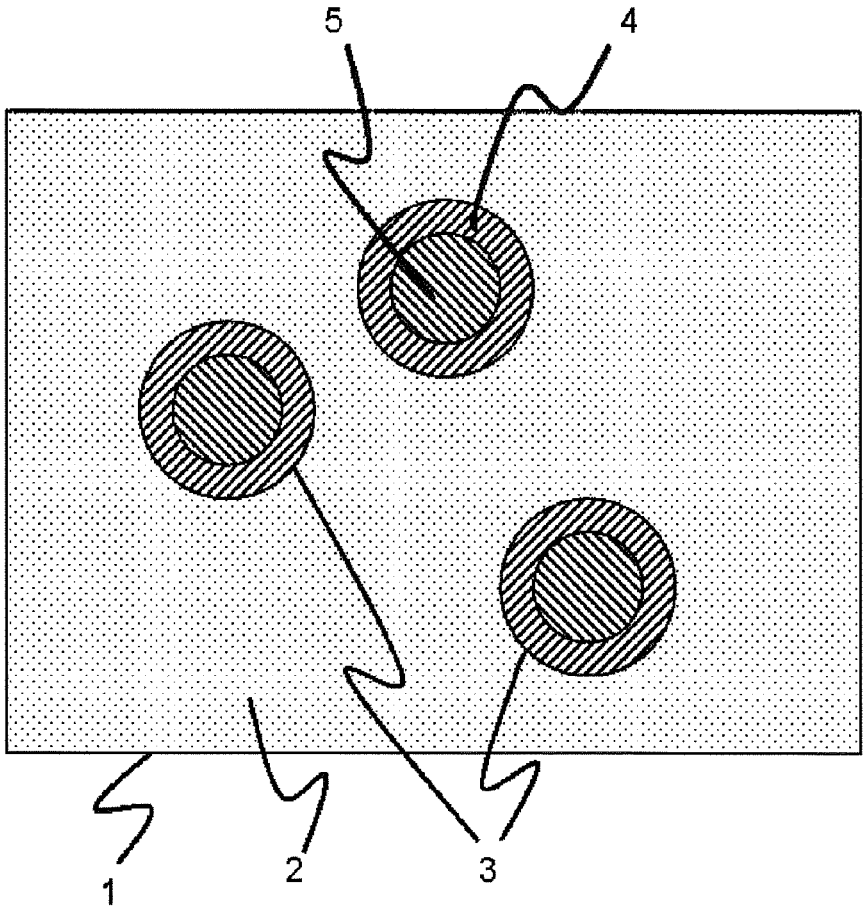
5
4
1
2
3

METHODS FOR MANUFACTURING PRINTED TEXTILES

CROSS-REFERENCE TO RELATED APPLICATIONS

This application is a 371 National Stage Application of PCT/EP2015/057672, filed Apr. 9, 2015. This application claims the benefit of European Application No. 14164670.3, filed Apr. 15, 2014, which is incorporated by reference herein in its entirety.

BACKGROUND OF THE INVENTION

1. Field of the Invention

The present invention relates to methods for manufacturing printed textiles and the resulting textiles there from.

2. Description of the Related Art

In the early days, coloured patterns in textiles were only made by weaving differently coloured yarns and fibres. Later analogue printing techniques, such as rotary or flatbed screen printing, were introduced for printing coloured patterns on both woven and non-woven textiles. Recently digital printing techniques, such as inkjet printing, are used because of their high flexibility in use, e.g. printing of variable images, and their enhanced reliability allowing their incorporation into industrial manufacturing lines.

In order to cover the wide range of available textiles, different types of inkjet inks have been developed containing also different types of colorants.

In so-called "direct printing" techniques inkjet inks are printed directly onto the textile with e.g. acid dye inks for printing on silk, polyamide and wool and reactive dye inks for printing on cellulose based textiles. This direct printing technique generally requires pre-treatments and post-treatments. A pre-treatment may, for example, consist of the application of a coating to improve image quality. A post-treatment may, for example, be a washing and drying step to remove dyes that did not react with the fibres of the textiles and to improve wash fastness. Another type of inkjet ink containing disperse dyes is only suitable for printing on some hydrophobic textiles such as polyester and nylon, and also requires a wash off post treatment. Purely from an economical and ecological perspective, it is desirable to have a digital printing technique which does not need these pre- and post treatments.

An approach to avoid these pre- and post treatments is the so-called "transfer printing" using an inkjet ink containing sublimation dyes. This indirect printing technique is illustrated by U.S. Pat. No. 5,488,907 (SAWGRASS), which discloses the inkjet printing of an image on a temporary medium using an ink composition comprising heat activated ink solids, without activating the ink solids during the process of printing onto the medium. The image is transferred from the medium to the textile on which the image is to permanently appear by applying sufficient heat and pressure to the medium to activate and transfer the ink to the textile. In this approach the pre- and post-treatments are replaced by a heat transfer step. It would be desirable to be able to avoid this heat transfer step as this causes not only extra waste by the temporary medium but also waste by imperfect heat transfer and other type of errors. In addition, transfer printing only functions well on a limited number of synthetic textiles, such as polyester.

In addition to a simplified manufacturing process of printed textiles, it is also desirable to improve the physical properties of the printed image such as wash fastness, chemical resistance, scratch resistance and flexibility. The latter is important as the printed image should not influence the look-and-feel of the textile. For example, pigmented UV curable inkjets have been used to print on textiles for improving wash fastness, chemical resistance and scratch resistance, but generally resulted in undesired plastic look-and-feel of the textile instead of the original look-and-feel of the textile. In addition, UV curable inkjet inks based on acrylate polymerizable compounds have a risk by printing on the fibre structure of the textile that uncured acrylates remain in the printed textile, which then may cause skin sensitivity or irritation after prolonged contact if no washing step is performed.

Encapsulation is a process in which tiny particles or droplets are surrounded by a shell to give small capsules. The material inside the capsule is referred to as the core or the internal phase, whereas the shell is sometimes called a wall. This technology has been applied in different technical fields, such as self healing compositions (Blaiszik et al., Annual Review of Materials, 40, 179-211 (2010)), textile treatment (Marinkovic et al., CI&CEQ 12(1), 58-62 (2006); Nelson G., International Journal of Pharmaceutics, 242, 55-62 (2002), Teixeira et al., AIChE Journal, 58(6), 1939-1950 (2012)), thermal energy storage and release for buildings (Tyagi et al., Renewable and Sustainable Energy Reviews, 15, 1373-1391 (2011)), printing and recording technology (Microspheres, Microcapsules and Liposomes: Volume 1: Preparation and Chemical Applications, editor R. Arshady, 391-417 and ibid., 420-438, Citus Books, London, 1999), personal care, pharmaceuticals, nutrition, agrochemicals (Lidert Z., Delivery System Handbook for Personal Care and Cosmetic Products, 181-190, Meyer R. Rosen (ed.), William Andrew, Inc. 2005; Schrooyen et al., Proceedings of the Nutrition Society, 60, 475-479 (2001)) and electronic applications (Yoshizawa H., KONA, 22, 23-31 (2004)).

The use of encapsulation technology in inkjet inks has largely been limited to the design of encapsulated pigments, where a polymer shell is directly polymerized on the surface of the pigment particles. For example, US 2009227711 A (XEROX) discloses encapsulated nanoscale particles of organic pigments, comprising a polymer-based encapsulating material, and one or more nanoscale organic pigment particles encapsulated by the polymer-based encapsulating material to be used as colorants for compositions such as inks, toners and the like. This approach doesn't allow boosting the physical properties needed in industrial applications.

JP 2004075759 (FUJI) discloses an inkjet ink including a microcapsule comprising at least one hydrophobic dye, at least one hydrophobic polymer and at least one high boiling solvent, where the capsule walls are prepared using a polyfunctional isocyanate compound. All the examples disclosed require the use of an additional water soluble polymer, i.e. gelatine.

Encapsulation as an approach to integrate reactive chemistry in inkjet inks has hardly been disclosed. US 2012120146 A (XEROX) discloses a curable ink comprising microcapsules. The microcapsules contain at least one first reactive component and at least one second component comprising a triggerable compound, and they are dispersed in at least one third reactive component. After stimulus induced rupture of the capsules, polymerisation of the ink is obtained by reaction of the at least one first reactive component with the third reactive component. From Example 6, it should be clear that the microcapsules are integrated into a UV curable ink rather then an aqueous based ink.

Therefore, there remains a need for methods for manufacturing printed textiles which allow direct printing on a wide range of textile substrates, which does not require any pre-treatments and post-treatments and wherein the resulting textile exhibits improved wash fastness, chemical resistance and scratch resistance, without impairing the typical look-and-feel of the textile.

SUMMARY OF INVENTION

In order to overcome the problems described above, preferred embodiments of the present invention have been realised with a method for manufacturing printed textiles as defined below.

It was found that the manufacturing method of printed textiles could be simplified by using thermally reactive chemistry incorporated into capsules in an aqueous inkjet ink and was applicable to a wide range of textiles. For example, there is currently to our knowledge no aqueous inkjet ink that can print on both cotton and polyester and exhibit good physical properties.

A very reliable manufacturing method could be realized by using self-dispersing capsules in the inkjet ink.

It was also surprisingly found that the chemical resistance was improved to such a high level that even bleach (hypochlorite) in many cases did not affect discoloration of the dyes in the capsules.

Further advantages and benefits of the invention will become apparent from the description hereinafter.

Definitions

The term "alkyl" means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethyl-propyl and 2-methyl-butyl, etc.

Unless otherwise specified a substituted or unsubstituted alkyl group is preferably a $C_1$ to $C_6$-alkyl group.

Unless otherwise specified a substituted or unsubstituted alkenyl group is preferably a $C_1$ to $C_6$-alkenyl group.

Unless otherwise specified a substituted or unsubstituted alkynyl group is preferably a $C_1$ to $C_6$-alkynyl group.

Unless otherwise specified a substituted or unsubstituted aralkyl group is preferably a phenyl or naphthyl group including one, two, three or more $C_1$ to $C_6$-alkyl groups.

Unless otherwise specified a substituted or unsubstituted alkaryl group is preferably a $C_7$ to $C_{20}$-alkyl group including a phenyl group or naphthyl group.

Unless otherwise specified a substituted or unsubstituted aryl group is preferably a phenyl group or naphthyl group Unless otherwise specified a substituted or unsubstituted heteroaryl group is preferably a five- or six-membered ring substituted by one, two or three oxygen atoms, nitrogen atoms, sulphur atoms, selenium atoms or combinations thereof.

The term "substituted", in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms Unless otherwise specified a substituted alkyl group, a substituted alkenyl group, a substituted alkynyl group, a substituted aralkyl group, a substituted alkaryl group, a substituted aryl and a substituted heteroaryl group are preferably substituted by one or more constituents selected from the group consisting of methyl, ethyl, n-propyl, isopropyl, n-butyl, isobutyl and tertiary-butyl, ester group, amide group, ether group, thioether group, ketone group, aldehyde group, sulfoxide group, sulfone group, sulfonate ester group, sulphonamide group, —Cl, —Br, —I, —OH, —SH, —CN and $—NO_2$.

BRIEF DESCRIPTION OF THE DRAWINGS

FIG. 1 shows an inkjet ink (1) including an aqueous medium (2) and capsules (3) composed of a polymeric shell (4) surrounding a core (5) containing one or more thermally curable compounds.

DETAILED DESCRIPTION OF THE PREFERRED EMBODIMENTS

Methods for Manufacturing Printed Textiles

The method for manufacturing printed textiles according to a preferred embodiment of the present invention includes at least the steps of a) inkjet printing an image onto a textile substrate with one or more inkjet inks including an aqueous medium and capsules composed of a polymeric shell surrounding a core which contains one or more thermally curable compounds; and b) thermally fixing the inkjet printed image.

In a preferred embodiment, the capsules have an average particle size of no more than 4 μm as determined by dynamic laser diffraction. This allows reliable jetting of the inkjet ink through the nozzles of the inkjet print head.

For the dispersion stability of the inkjet ink, the capsules are preferably dispersed in the aqueous medium using a dispersing group covalently bonded to the polymeric shell. The dispersing group is preferably selected from the group consisting of a carboxylic acid or salt thereof, a sulfonic acid or salt thereof, a phosphoric acid ester or salt thereof, a phosphonic acid or salt thereof, an ammonium group, a sulfonium group, a phosphonium group and a polyethylene oxide group.

The colorants for the inkjet ink are preferably selected from the group consisting of a pigment and a disperse dye. Pigments are preferred when high light fastness is required, while disperse dyes are preferred when a certain transparency or translucency is desired.

The thermal fixing is performed by a heat treatment having a certain temperature and duration which is adjusted to the type of textile and the reactivity of the thermal chemistry. Such thermal treatments are today already used with other types of inkjet ink and their implementation is well-known in the art. For example, reactive dye inks often receive a thermal treatment of 8 to 10 minutes at 100° C., for example by steaming. For disperse dye inks often higher temperatures are used at a shorter time, e.g. 1 minute at 200° C. The thermal fixing in the method for manufacturing printed textiles according to a preferred embodiment of the present invention can be performed by a heat treatment applied by an oven, heated rollers, steaming and the like.

Many pre-treatments of textiles can be avoided. For example, where classic inkjet printing processes require the application of a water-soluble polymer to the textile prior to inkjet printing in order to prevent ink bleeding, this is usually not necessary with inkjet inks containing capsules. If the colorant is included in the core of the capsule, than bleeding is more or less limited to the size of the capsule. With the exception of the thermal fixing of the inkjet printed image, also post-treatments are normally not necessary in a preferred embodiment of the current invention. A typical post-treatment, such as a classic washing process to remove dyes that are unfixed from the textile, is not necessary.

The avoidance of these pre- and post treatment speed-up and simplify the manufacturing of inkjet printed textiles, resulting in an economical bonus. For example, no cumbersome ink swaps have to be performed in the inkjet printer, when changing the type of textile substrate. Also waste generated in the post-treatment can be avoided. However, although pre- or post-treatments are not required, they may nevertheless be combined in the method for manufacturing printed textiles according to a preferred embodiment of the present invention, especially if they would have some benefit, for example, if they would further improve the image quality of the inkjet printed image.

Inkjet Printed Textiles

An inkjet printed textile according to a preferred embodiment of the present invention contains a printed image on a textile substrate wherein pigments and/or disperse dyes are at least partially encapsulated by polymeric shell material from capsules composed of a polymeric shell surrounding a core.

The textile substrates may be transparent, translucent or opaque.

A major advantage of the inkjet printing method according to preferred embodiments of the present invention is that printing can be performed on a wide range of textiles.

Suitable textiles can be made from many materials. These materials come from four main sources: animal (e.g. wool, silk), plant (e.g. cotton, flax, jute), mineral (e.g. asbestos, glass fibre), and synthetic (e.g. nylon, polyester, acrylic). Depending on the type of material, it can be woven or non-woven textile.

The textile substrate is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles (e.g. Spandex or Lycra™), high density polyethylene textiles (Tyvek™) and mixtures thereof.

Suitable polyester textile includes polyethylene terephthalate textile, cation dyeable polyester textile, acetate textile, diacetate textile, triacetate textile, polylactic acid textile and the like.

Applications of these textiles include automotive textiles, canvas, banners, flags, interior decoration, clothing, swimwear, sportswear, ties, scarves, hats, floor mats, doormats, carpets, mattresses, mattress covers, linings, sacking, upholstery, carpets, curtains, draperies, sheets, pillowcases, flame-retardant and protective fabrics, and the like. Polyester fibre is used in all types of clothing, either alone or blended with fibres such as cotton. Aramid fibre (e.g. Twaron) is used for flame-retardant clothing, cut-protection, and armour. Acrylic is a fibre used to imitate wools.

Inkjet Inks

The inkjet inks used in a preferred embodiment of the present invention include at least a) an aqueous medium; and b) capsules composed of a polymeric shell surrounding a core which contains one or more thermally curable compounds.

A thermally curable compound is a compound that forms a reaction polymeric product upon direct or indirect application of heat. Indirect application of heat means that the inkjet ink contains an optothermal converting agent, such as an infrared dye, for the conversion of electromagnetic radiation into heat. The inkjet ink, preferably the core of the capsules, may contain an optothermal converting agent for the conversion of infrared light into heat when the inkjet printed image is exposed to an infrared light source, such as a laser, a laser diode or a LED.

In a preferred embodiment, the inkjet ink is part of an inkjet ink set, more preferably part of a multi colour inkjet ink set. The inkjet ink set preferably includes at least a cyan inkjet ink, a magenta inkjet ink, a yellow inkjet ink and a black inkjet ink. Such a CMYK-inkjet ink set may also be extended with extra inks such as red, green, blue, violet and/or orange to further enlarge the colour gamut of the image. The inkjet ink set may also be extended by the combination of the full density inkjet inks with light density inkjet inks. The combination of dark and light colour inks and/or black and grey inks improves the image quality by a lowered graininess.

The inkjet ink set may also include one or more spot colours, for example one or more corporate colours, such as e.g. the red colour of Coca-Cola™.

The inkjet ink set may also include a varnish for improving the gloss on certain textiles.

In a preferred embodiment, the inkjet ink set also includes a white inkjet ink. This allows obtaining more brilliant colours, especially on transparent substrates, where the white inkjet ink can be applied either as a primer or on top of the colour inkjet inks when the image is viewed through the transparent substrate.

The viscosity of the inkjet ink is preferably smaller than 25 mPa·s at 25° C. and at a shear rate of 90 $s^{-1}$, more preferably between 2 and 15 mPa·s at 25° C. and at a shear rate of 90 $s^{-1}$.

The surface tension of the inkjet ink is preferably in the range of about 18 mN/m to about 70 mN/m at 25° C., more preferably in the range of about 20 mN/m to about 40 mN/m at 25° C.

The inkjet ink may also contain at least one surfactant for obtaining good spreading characteristics on a substrate.

The capsules are preferably present in the inkjet ink in amount of no more than 27 wt %, preferably between 5 and 25 wt % based on the total weight of the inkjet ink. It was observed that above 27 wt % jetting was not always so reliable.

Capsules

The capsules have a polymeric shell surrounding a core containing thermal reactive chemistry, i.e. at least one thermally curable compound.

The capsules preferably have an average particle size of no more than 4 μm as determined by dynamic laser diffraction. The nozzle diameter of inkjet print heads is usually 20 to 35 μm. Reliable inkjet printing was found to be possible if the average particle size of the capsules is preferably at least five times smaller than the nozzle diameter. An average particle size of no more than 4 μm allows jetting by current commercially available print heads having a smallest nozzle diameter of 20 μm. In a more preferred embodiment, the average particle size of the capsules is preferably at least ten times smaller than the nozzle diameter. Hence preferably, the average particle size of the capsules is from 0.05 to 2 μm, more preferably from 0.10 to 1 μm. When the average particle size of the capsule is smaller than 2 μm, excellent resolution and dispersion stability with time are obtained.

Reviewing the synthetic approaches for the synthesis of microcapsules in general, it becomes clear that the use of an additional hydrophilic polymer is required to control the colloid stability, the particle size and the particle size distribution, which are three critical factors for the design of an inkjet ink. However, the use of water soluble polymers in aqueous based inkjet inks often has a detrimental impact on jetting reliability and latency, aspects which are particularly important in an industrial environment where down time and complex maintenance cycles have to be avoided.

In a preferred embodiment, the capsules are dispersed in the aqueous medium of the inkjet ink using a dispersing group covalently bonded to the polymeric shell. The dispersing group is preferably selected from a group consisting of a carboxylic acid or salt thereof, a sulfonic acid or salt thereof, a phosphoric acid ester or salt thereof, a phosphonic acid or salt thereof, an ammonium group, a sulfonium group, a phosphonium group and a polyethylene oxide group.

The dispersing group can be used in combination with a polymeric dispersant in order to accomplish steric stabilization. For example, the polymeric shell may have covalently bonded carboxylic acid groups that interact with amine groups of a polymeric dispersant. However, in a more preferred embodiment, no polymeric dispersant is used and dispersion stability of the inkjet ink is accomplished solely by electrostatic stabilization. For example, a slightly alkaline aqueous medium will turn the carboxylic acid groups covalently bonded to the polymeric shell into ionic groups, whereafter the negatively charged capsules have no tendency to agglomerate. If sufficient dispersing groups are covalently bonded to the polymeric shell, the capsule becomes a so-called self-dispersing capsule. Other dispersing groups such as sulfonic acid groups tend to be dissociated even an in acid aqueous medium and thus doesn't require the addition of an alkali.

These negatively or positively charged capsule surfaces can also be advantageously used during inkjet printing. For example, a second liquid containing a cationic substance, such as a compound containing ammonium groups, can be used to precipitate capsules and, if polymeric or multivalent cations are used, to bind capsules together by interaction with the dissociated carboxylic acid groups covalently bonded to the polymeric shell. By using this method an improvement in image quality can be observed due to the immobilisation of the capsules.

There is no real limitation on the type of polymer used for the polymeric shell of the capsule. Preferably, the polymer used in the polymeric shell is crosslinked. By crosslinking, more rigidity is built into the capsules allowing a broader range of temperatures and pressures for handling the capsules in both the ink making and in the inkjet printer.

Preferred examples of the polymeric shell material include polyureas, polyurethanes, polyesters, polycarbonates, polyamides, melamine based polymers and mixtures thereof, with polyureas and polyurethanes being especially preferred.

Capsules can be prepared using both chemical and physical methods. Suitable encapsulation methodologies include complex coacervation, liposome formation, spray drying and polymerization methods.

In a preferred embodiment of the present invention, preferably a polymerization method is used as it allows the highest control in designing the capsules. More preferably interfacial polymerization is used to prepare the capsules. This technique is well-known and has recently been reviewed by Zhang Y. and Rochefort D. (Journal of Microencapsulation, 29(7), 636-649 (2012) and by Salitin (in Encapsulation Nanotechnologies, Vikas Mittal (ed.), chapter 5, 137-173 (Scrivener Publishing LLC (2013)).

Interfacial polymerisation is a particularly preferred technology for the preparation of capsules according to a preferred embodiment of the present invention. In interfacial polymerization, such as interfacial polycondensation, two reactants meet at the interface of the emulsion droplets and react rapidly.

In general, interfacial polymerisation requires the dispersion of an oleophilic phase in an aqueous continuous phase or vice versa. Each of the phases contains at least one dissolved monomer (a first shell component) that is capable of reacting with another monomer (a second shell component) dissolved in the other phase. Upon polymerisation, a polymer is formed that is insoluble in both the aqueous and the oleophilic phase. As a result, the formed polymer has a tendency to precipitate at the interface of the oleophilic and aqueous phase, hereby forming a shell around the dispersed phase, which grows upon further polymerisation. The capsules according to a preferred embodiment of the present invention are preferably prepared from an oleophilic dispersion in an aqueous continuous phase.

Typical polymeric shells, formed by interfacial polymerisation are selected from the group consisting of polyamides, typically prepared from di- or oligoamines as first shell component and di- or poly-acid chlorides as second shell component; polyurea, typically prepared from di- or oligoamines as first shell component and di- or oligoisocyanates as second shell component; polyurethanes, typically prepared from di- or oligoalcohols as first shell component and di- or oligoisocyanates as second shell component; polysulfonamides, typically prepared from di- or oligoamines as first shell component and di- or oligosulfochlorides as second shell component; polyesters, typically prepared from di- or oligoalcohols as first shell component and di- or oligo-acid chlorides as second shell component; and polycarbonates, typically prepared from di- or oligoalcohols as first shell component and di- or oligo-chloroformates as second shell component. The shell can be composed of combinations of these polymers.

In a further embodiment, polymers, such as gelatine, chitosan, albumin and polyethylene imine can be used as first shell components in combination with a di- or oligo-isocyanate, a di- or oligo acid chloride, a di- or oligo-chloroformate and an epoxy resin as second shell component.

In a particularly preferred embodiment, the shell is composed of a polyurethane, a polyurea or a combination thereof. In a further preferred embodiment, a water immiscible solvent is used in the dispersion step, which is removed by solvent stripping before or after the shell formation. In a particularly preferred embodiment, the water immiscible solvent has a boiling point below 100° C. at normal pressure. Esters are particularly preferred as water immiscible solvent. A preferred organic solvent is ethyl acetate, because it also has a low flammability hazard compared to other organic solvents.

A water immiscible solvent is an organic solvent having low miscibility in water. Low miscibility is defined as any water solvent combination forming a two phase system at 20° C. when mixed in a one over one volume ratio.

The method for preparing a dispersion of capsules preferably includes the following steps:

a) preparing a non-aqueous solution of a first reactant for forming a polymeric shell, one or more thermally curable compounds and optionally a water immiscible organic solvent having a lower boiling point than water;

b) preparing an aqueous solution of a second reactant for forming the polymeric shell;

c) dispersing the non-aqueous solution under high shear in the aqueous solution;

d) optionally stripping the water immiscible organic solvent from the mixture of the aqueous solution and the non-aqueous solution; and e) preparing the polymeric shell around the one or more thermally curable compounds by interfacial polymerization of the first and second reactants for forming the polymeric shell.

The capsule dispersion can then be completed into an inkjet ink by addition of e.g. water, humectants, surfactant and the like.

Other additives may be included into the core of the capsule such as, for example, light stabilizers, conductive particles and polymers, magnetic particles, or other compounds suitable for the specific application for which the inkjet ink is used.

Thermal Reactive Chemistry

In a preferred embodiment of the inkjet ink, the one or more chemical reactants include a thermally curable compound. The thermally curable compound is preferably a low molecular, oligomer or polymer compound functionalized with at least one functional group selected from the group consisting of an epoxide, an oxetane, an aziridine, an azetidine, a ketone, an aldehyde, a hydrazide and a blocked isocyanate. In a further preferred embodiment, the thermally curable compound or thermally reactive chemistry is selected from the group consisting of an optionally etherified condensation product of formaldehyde and melamine, an optionally etherified condensation product of formaldehyde and ureum and a phenol formaldehyde resin, preferably a resole.

The thermally reactive chemistry can be a one component or a two component system. A one component system is defined as a reactive system that is capable of forming a polymeric resin or crosslinked network by reacting on its own upon thermal activation. A two component system is defined as a reactive system that is capable of forming a polymeric resin or crosslinked network by reacting with a second component in the system upon thermal activation. The second component can be present in the aqueous continuous phase, in a separate dispersed phase, e.g. in the core of a capsule, on the substrate used for inkjet printing or a combination thereof. Typical two component thermally reactive systems are selected from the group consisting of a ketone or aldehyde and a hydrazide, an epoxide or oxetane and an amine, a blocked isocyanate and an alcohol and a blocked isocyanate and an amine. Blocked isocyanates are particularly preferred.

Synthesis of blocked isocyanates is well-known to the skilled person and has been reviewed by Wicks D. A. and Wicks Z. W. Jr. (Progress in Organic Coatings, 36, 148-172 (1999)) and Delebecq et al. (Chem. Rev., 113, 80-118 (2013)). Classic blocked isocyanates are defined as chemical components that are capable of forming isocyanates from a precursor upon thermal treatment. In general, the reaction can be summarized as given in scheme 1 below.

Scheme 1:

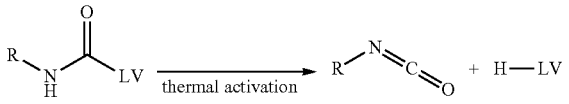

The activation temperature, also called deblocking temperature, is dependent on the leaving group and is selected dependent on the application. Suitable isocyanate precursors are given below having a variable deblocking temperature between 100° C. and 160° C.

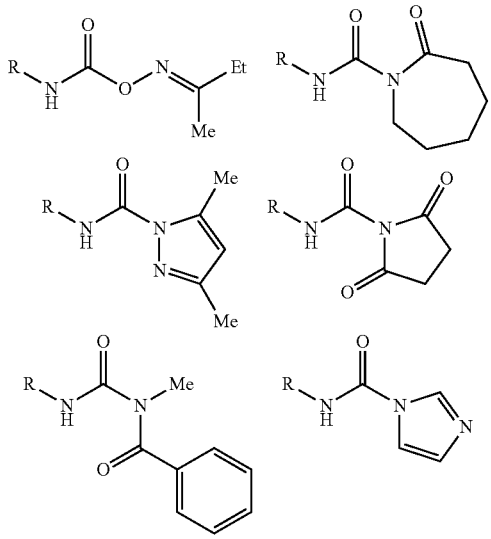

In the above six isocyanate precursors, R represents the residue of a difunctional, multifunctional or polymeric blocked isocyanate. Difunctional and multifunctional blocked isocyanates are preferred. In a further preferred embodiment, R represents a hydrocarbon group, further functionalized with at least one and preferably two or more blocked isocyanates, where the blocked isocyanates can be the same as or different from the first blocked isocyanate listed above. The hydrocarbon group preferably comprises no more then 40 carbon atoms, more preferably no more then 30 carbon atoms and most preferably between 8 and 25 carbon atoms. The same blocked isocyanate functional groups as the first blocked isocyanate are preferred. In a further preferred embodiment R comprises aliphatic, cycloaliphatic or aromatic fragments or combinations thereof. Preferred aliphatic fragments are linear or branched saturated hydrocarbon chains comprising 2 to 12 carbon atoms. Preferred cycloaliphatic fragments are five or six membered saturated hydrocarbon rings, six membered hydrocarbon rings being particularly preferred. Preferred aromatic fragments are selected from the group consisting of phenyl rings and naphtyl rings, phenyl rings being particularly preferred. In a particularly preferred embodiment R comprises at least one fragment selected from the group consisting of a [1,3,5]triazinane-2,4,6-trione fragment and a biuret fragment.

Active methylene compounds as blocking agents are widely used as alternatives for classic blocked isocyanates, operating via an alternative reaction pathway, not yielding an intermediate isocyanate but crosslinking the system via ester formation as disclosed in Progress in Organic Coatings, 36, 148-172 (1999), paragraph 3.8. Suitable examples of active methylene group blocked isocyanates are given below:

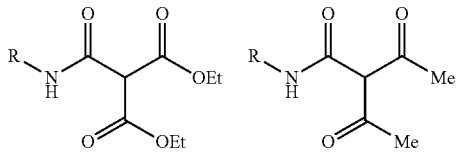

-continued

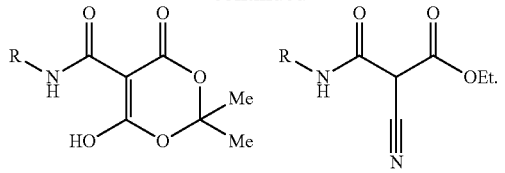

In the above four compounds, R represents the residue of a difunctional, multifunctional or polymeric blocked isocyanate or active methylene group blocked isocyanate. Difunctional and multifunctional blocked isocyanates or active methylene group blocked isocyanates are preferred. In a further preferred embodiment, R represents a hydrocarbon group, further functionalized with at least one and preferably two or more blocked isocyanates or active methylene group blocked isocyanates, where the blocked isocyanates can be the same as or different from the first active methylene group blocked isocyanate listed above. The hydrocarbon group preferably comprises no more then 40 carbon atoms, more preferably no more then 30 carbon atoms and most preferably between 8 and 25 carbon atoms. Di- or multifunctional active methylene group blocked isocyanates are preferred, all blocking functional groups being the same being particularly preferred. In a further preferred embodiment R comprises, aliphatic, cycloaliphatic or aromatic fragments or combinations thereof. Preferred aliphatic fragments are linear or branched saturated hydrocarbon chains comprising 2 to 12 carbon atoms. Preferred cycloaliphatic fragments are five or six membered saturated hydrocarbon rings, six membered hydrocarbon rings being particularly preferred. Preferred aromatic fragments are selected from the group consisting of phenyl rings and naphtyl rings, phenyl rings being particularly preferred. In a particularly preferred embodiment R comprises at least one fragment selected from the group consisting of a [1,3,5]triazinane-2,4,6-trione fragment and a biuret fragment.

In a preferred embodiment, the blocked isocyanate is a polyfunctional blocked isocyanate having two to six blocked isocyanate functions. Tri- and tetrafunctional blocked isocyanates are particularly preferred.

Preferred blocked isocyanates are precursors capable of forming a di- or multifunctional isocyanate upon thermal activation selected from the group of hexamethylene diisocyanate, isophorone diisocyanate, tolyl diisocyanate, xylylene diisocyanate, a hexamethylene diisocyanate trimer, trimethylhexylene diisocyanate, diphenylmethane diisocyanate, dicyclohexylmethane diisocyanate and condensation products of one or more of the previous isocyanates. Other preferred blocked isocyanates are derivatives from the Takenate™ series of isocyanates (Mitsui), the Duranate™ series (Asahai Kasei Corporation) and the Bayhydur™ series (Bayer AG).

Suitable blocked isocyanates can be selected from the Trixene™ series (Baxenden Chemicals LTD) and the Bayhydur™ series (Bayer AG). Preferred examples of blocked isocyanates are given below in Table 1 without being limited thereto.

TABLE 1

ISO-1

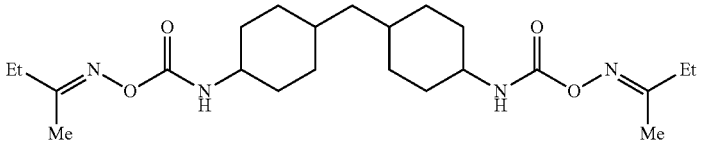

ISO-2

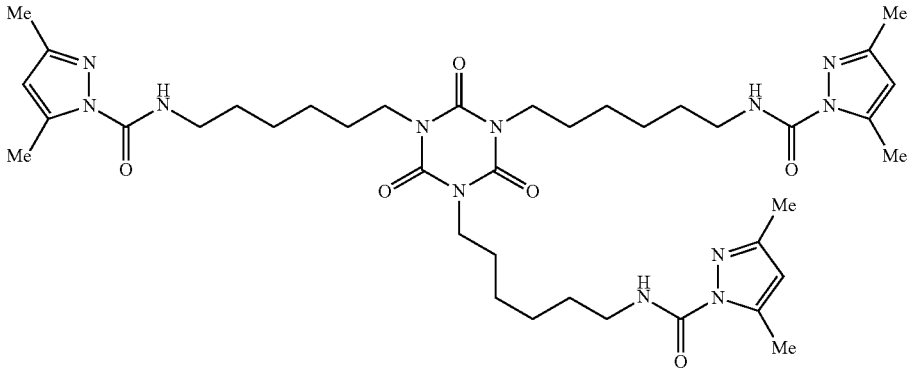

ISO-3

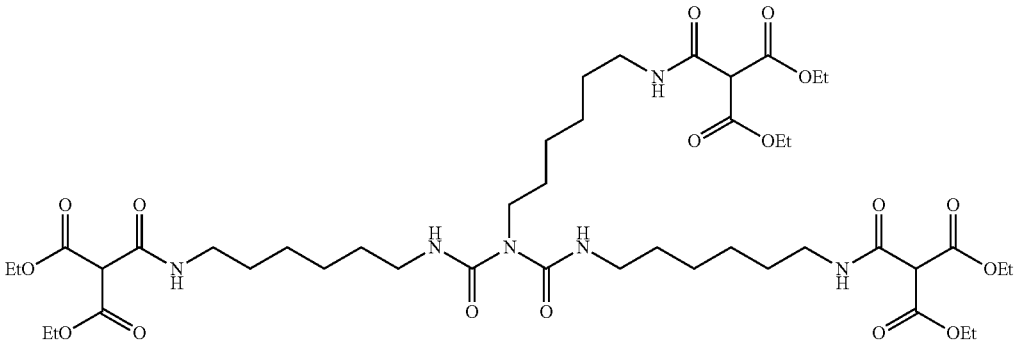

TABLE 1-continued
ISO-4
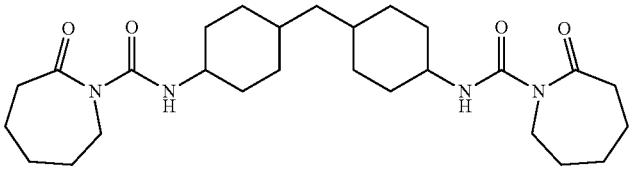
ISO-5
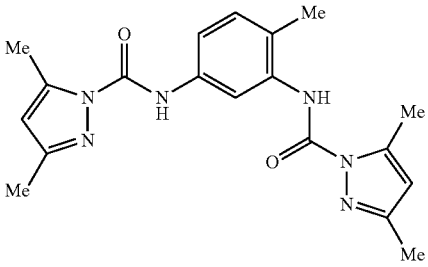
ISO-6
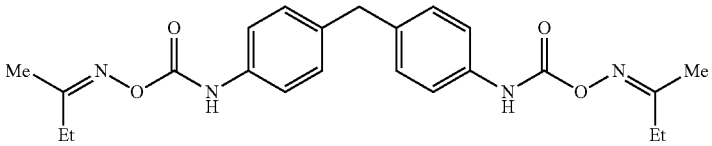
ISO-7
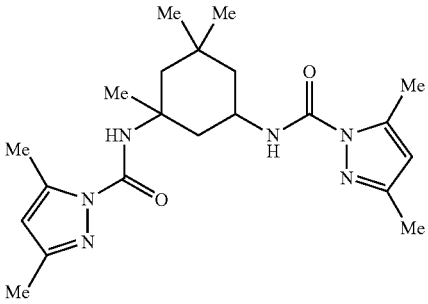
ISO-8
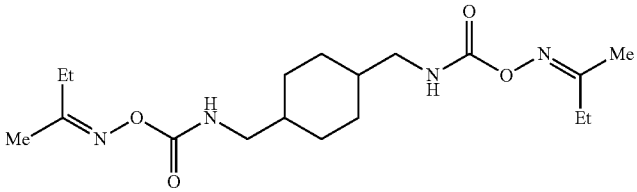
ISO-9
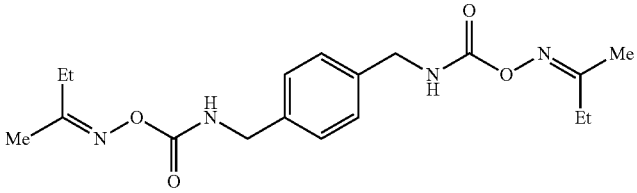
ISO-10
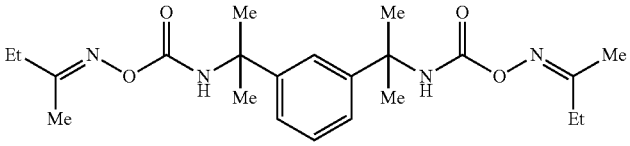

In a further embodiment, the inkjet ink may further comprise a catalyst to activate said thermally reactive chemistry. The catalyst is preferably selected from the group consisting of a Brönsted acid, a Lewis acid and thermal acid generator. The catalyst can be present in the aqueous continuous phase, in the core of the capsule or in a separate dispersed phase.

Aqueous Medium

The capsules are dispersed into an aqueous medium. The aqueous medium may consist of water, but preferably includes one or more organic solvents. Other compounds, such as e.g. monomers and oligomers, surfactants, colorants, alkaline compounds and light stabilizers, may be dissolved or dispersed in the aqueous medium.

The one or more organic solvents may be added for a variety of reasons. For example, it can be advantageous to add a small amount of an organic solvent to improve the dissolution of a compound in the aqueous medium.

The aqueous medium may contain at least one humectant to prevent the clogging of the nozzle, due to its ability to slow down the evaporation rate of inkjet ink, especially the water in the inkjet ink. A humectant is an organic solvent having a smaller evaporation rate than water.

Suitable humectants include triacetin, N-methyl-2-pyrrolidone, glycerol, urea, thiourea, ethylene urea, alkyl urea, alkyl thiourea, dialkyl urea and dialkyl thiourea, diols, including ethanediols, propanediols, propanetriols, butanediols, pentanediols, and hexanediols; glycols, including propylene glycol, polypropylene glycol, ethylene glycol, polyethylene glycol, diethylene glycol, tetraethylene glycol, and mixtures and derivatives thereof. A preferred humectant is glycerol.

The humectant is preferably added to the ink-jet ink formulation in an amount of 0.1 to 20 wt % based on the total weight of the inkjet ink.

The aqueous medium preferably includes at least one surfactant. The surfactant can be anionic, cationic, nonionic, or zwitter-ionic and is preferably added in an amount below 10 wt %, more preferably below 5 wt % based on the total inkjet ink weight.

Suitable surfactants include fatty acid salts, ester salts of a higher alcohol, alkylbenzene sulphonate salts, sulphosuccinate ester salts and phosphate ester salts of a higher alcohol (e.g. sodium dodecylbenzenesulphonate and sodium dioctylsulphosuccinate), ethylene oxide adducts of a higher alcohol, ethylene oxide adducts of an alkylphenol, ethylene oxide adducts of a polyhydric alcohol fatty acid ester, and acetylene glycol and ethylene oxide adducts thereof (for example, polyoxyethylene nonylphenyl ether, and SURFYNOL™ 104, 440, 465 and TG available from AIR PRODUCTS & CHEMICALS INC.

A biocide may be added to the aqueous medium to prevent unwanted microbial growth, which may occur in the ink-jet ink over time. The biocide may be used either singly or in combination.

Suitable biocides for the ink-jet ink of a preferred embodiment of the present invention include sodium dehydroacetate, 2-phenoxyethanol, sodium benzoate, sodium pyridinethion-1-oxide, ethyl p-hydroxybenzoate and 1,2-benzisothiazolin-3-one and salts thereof.

Preferred biocides are Proxel™ GXL and Proxel™ Ultra 5 available from ARCH UK BIOCIDES and Bronidox™ available from COGNIS.

A biocide is preferably added to the aqueous medium in an amount of 0.001 to 3 wt. %, more preferably 0.01 to 1.0 wt. %, each based on the inkjet ink.

The aqueous medium may further comprise at least one thickener for viscosity regulation in the inkjet ink.

Suitable thickeners include urea or urea derivatives, hydroxyethylcellulose, carboxymethylcellulose, hydroxypropylcellulose, derived chitin, derived starch, carrageenan, pullulan, proteins, poly(styrenesulphonic acid), poly(styrene-co-maleic anhydride), poly(alkyl vinyl ether-co-maleic anhydride), polyacrylamide, partially hydrolyzed polyacrylamide, poly(acrylic acid), poly(vinyl alcohol), partially hydrolyzed poly(vinyl acetate), poly(hydroxyethyl acrylate), poly(methyl vinyl ether), polyvinylpyrrolidone, poly (2-vinylpyridine), poly(4-vinylpyridine) and poly(diallyldimethylammonium chloride).

The thickener is added preferably in an amount of 0.01 to 20 wt %, more preferably 0.1 to 10 wt % based on the inkjet ink.

The inkjet ink may further comprise at least one antioxidant for improving the storage stability of an image.

As the antioxidant for improving storage stability of an image, various organic and metal complex type fading preventives can be used in a preferred embodiment of the invention. Organic fading preventives include hydroquinones, alkoxyphenols, dialkoxyphenols, phenols, anilines, amines, indanes, coumarones, alkoxyanilines and heterocycles, while metal complexes include nickel complexes and zinc complexes. More specifically, compounds as described in "Research Disclosure, No. 17643, VII, Section I or J, No. 15162, No. 18716, left column on page 650, No. 36544, page 527, No. 307105, page 872, and the patent cited in No. 15162, and compounds embraced in the formula of the typical compounds and compound examples described on pages 127 to 137 of JP 62215272 A (FUJI).

The stabilizer is added in an amount of 0.1 to 30 wt %, preferably 1 to 10 wt % based on the total weight of the inkjet ink.

The aqueous medium may contain at least one pH adjuster. Suitable pH adjusters include organic amines, NaOH, KOH, $NEt_3$, $NH_3$, HCl, $HNO_3$ and $H_2SO_4$. In a preferred embodiment, the inkjet ink has a pH higher than 7. A pH of 7, 8 or more can advantageously influence the electrostatic stabilization of the capsules, especially when the dispersing groups are carboxylic acid groups.

The aqueous medium may also includes polymeric latex particles. There is no limitation on the type of polymeric latex used in the aqueous medium. The polymer latex is preferably a self-dispersible latex, i.e. having ionic or ionizable groups such as e.g. the dispersing groups of the capsules.

The polymer latex may be selected from an acrylate based latex, a styrene based latex, polyester based latex, and a polyurethane based latex. The polymer latex is preferably a polyurethane latex, more preferably a self-dispersible polyurethane latex. The term "polyurethane based" means that the majority of the polymer in the polymer latex consists of polyurethane. Preferably at least 50 wt %, more preferably at least 70 wt % of the polymer in the polyurethane latex consists of polyurethane.

In a particularly preferred embodiment, the aqueous medium contains inter-crosslinkable latex particles, more preferably inter-crosslinkable polyurethane based latex particles. Suitable examples of inter-crosslinkable latex particles are disclosed by EP 2467434 A (HP).

Preferably a crosslinker is used to crosslink the polymerized monomers of the latex particles in order to enhance the durability of the latex particle. The crosslinker may be a separate compound or can be a cross-linking monomer. For example, in a (partly) acrylate based latex, the crosslinker may be a polyfunctional monomer or oligomers such as, without limitation, ethylene glycol dimethacrylate, diethylene glycol dimethacrylate, ethylene glycol diacrylate, diethylene glycol diacrylate, 1,6-hexanediol diacrylate, tetraethylene glycol diacrylate, tripropylene glycol diacrylate, ethoxylated bisphenol A diacrylate, pentaerythritol tri- and tetraacrylate, N,N'-methylenebisacrylamide, divinylbenzene and combinations thereof, mixtures thereof, and derivatives thereof. When present, the crosslinkers preferably comprise from 0.1 wt % to 15 wt % of the polymerized monomers.

The polymer latex in a preferred embodiment of the invention is preferably a self-dispersing polymer latex, and more preferably a self-dispersing polymer latex having a carboxyl group. A self-dispersing polymer latex means that it does not require a free emulsifier and that they can get into a dispersed state in an aqueous medium even in the absence of other surfactants due to a functional group, preferably an acidic group or a salt thereof, covalently bonded tot the latex. In preparing a self-dispersing polymer latex, preferably a monomer is used containing a carboxylic acid group, a sulfonic acid group or a phosphoric acid group.

Specific examples of the unsaturated carboxylic acid monomer include acrylic acid, methacrylic acid, crotonic acid, itaconic acid, maleic acid, fumaric acid, citraconic acid, and 2-methacryloyloxy methylsuccinic acid. Specific examples of the unsaturated sulfonic acid monomer include styrene sulfonic acid, 2-acrylamido-2-methyl propane sulfonic acid, 3-sulfopropyl (meth)acrylate, and bis-(3-sulfopropyl)-itaconate. Specific examples of the unsaturated phosphoric acid monomer include vinyl phosphoric acid, vinyl phosphate, and bis(methacryloxyethyl)phosphate.

The latex preferably has a glass transition temperature (Tg) of no more than 70° C., more preferably no more than 50° C.

The minimum film-forming temperature (MFT) of the polymer latex is preferably between −50 and 70° C., more preferably between −40 and 50° C.

The average particle size of the latex particles in the inkjet ink is preferably less than 300 nm, more preferably less than 200 nm as measured by laser diffraction, e.g. using a Beckman Coulter™ LS 13320.

Stabilizers

The inkjet ink may contain a stabilizer in the aqueous medium, but preferably the light stabilizer is included in the core of the capsule. By including the stabilizer in the core of the capsule, it is more effective as it is located in the immediate vicinity of the colorant.

The stabilizers are preferably selected from the group consisting of primary antioxidants, such as sterically hindered phenoles, secondary antioxidants, such as trivalent phosphorous compounds, metal deactivators, UV absorbers, such as hydroxybenzophenones, benzotriazole-2-phenoles and triazinyl phenols, and hindered amine light stabilizers. Suitable stabilizers are disclosed in Plastic Additives Handbook 5$^{th}$ edition, page 98 to 136 (ed. Hans Zweifel, Hansen Publisher Munich, ISBN 3-446-21654-4), herein incorporated as reference.

Colorants

The colorants used in the inkjet ink may be dyes, pigments or a combination thereof. Organic and/or inorganic pigments may be used.

The colorant for use is not particularly limited, and may be selected properly from various known colorants according to applications. For example, use of a pigment is preferable for forming an image superior in light fading and weather resistance. On the contrary, use of a dye is preferable, for forming an image superior in transparency on a transparent film. Either a water- or oil-soluble dye may be used as the dye. Preferably the dye is an oil-soluble dye because it can be incorporated in the core of the capsule, and exhibits a much better water resistance than images printed with water soluble dyes in the aqueous medium. In fact it has been observed that colorants, such as disperse dyes, are well protected when incorporated into the core of the capsule even against aggressive chemicals like hypochlorite. The latter can be exploited in inkjet printing on textiles for allowing thorough cleaning with concentrated detergents.

The colorant is preferably a pigment or a polymeric dye for reasons of light fastness.

The pigments may be black, white, cyan, magenta, yellow, red, orange, violet, blue, green, brown, mixtures thereof, and the like. A colour pigment may be chosen from those disclosed by HERBST, Willy, et al. Industrial Organic Pigments, Production, Properties, Applications. 3rd edition. Wiley-VCH, 2004. ISBN 3527305769.

Suitable pigments are disclosed in paragraphs [0128] to [0138] of WO 2008/074548 (AGFA GRAPHICS).

An advantage of including the pigments in the core of the capsule, is that high dispersion stability of the pigment is not really necessary as the dispersion stability is accomplished by the capsules in the inkjet ink. As long as pigments are dispersed sufficiently to be handled in the capsule formation process, there is no need to optimize dispersion stability.

The pigments are preferably included in the core of the capsules, but alternatively the pigment particles can be included in the aqueous medium. The colour pigment can be dispersed using a polymeric dispersant, but preferably a self-dispersible pigment is used. The latter prevents interaction of the polymeric dispersant with the dispersing groups of the capsules in the inkjet ink, since dispersion stability of the pigment is accomplished by the same technique of electrostatic stabilization as employed for the capsules.

A self-dispersible pigment is a pigment having on its surface covalently bonded anionic or cationic hydrophilic groups, such as salt-forming groups or the same groups used as dispersing groups for the capsules, that allow the pigment to be dispersed in an aqueous medium without using a surfactant or a resin.

The technology for making self-dispersible pigments is well-known. For example, EP 1220879 A (CABOT) discloses pigments having attached a) at least one steric group and b) at least one organic ionic group and at least one amphiphilic counterion, wherein the amphiphilic counterion has a charge opposite to that of the organic ionic group that are suitable for inkjet inks. Also EP 906371 A (CABOT) discloses suitable surface-modified coloured pigment having attached hydrophilic organic groups containing one or more ionic groups or ionizable groups. Suitable commercially available self-dispersible colour pigments are, for example, the CAB-O-JET™ inkjet colorants from CABOT.

Pigment particles in inkjet inks should be sufficiently small to permit free flow of the ink through the inkjet-printing device, especially at the ejecting nozzles. It is also desirable to use small particles for maximum colour strength and to slow down sedimentation.

The average pigment particle size is preferably between 0.050 and 1 μm, more preferably between 0.070 and 0.300 μm and particularly preferably between 0.080 and 0.200 μm. Most preferably, the numeric average pigment particle size is no larger than 0.150 μm. The average particle size of pigment particles is determined with a Brookhaven Instruments Particle Sizer BI90plus based upon the principle of dynamic light scattering. The ink is diluted with ethyl acetate to a pigment concentration of 0.002 wt %. The measurement settings of the BI90plus are: 5 runs at 23° C., angle of 90°, wavelength of 635 nm and graphics=correction function However for white pigment inkjet inks, the numeric average particle diameter of the white pigment is preferably from 50 to 500 nm, more preferably from 150 to 400 nm, and most preferably from 200 to 350 nm. Sufficient hiding power cannot be obtained when the average diameter is less than 50 nm, and the storage ability and the jet-out suitability of the ink tend to be degraded when the average diameter exceeds 500 nm. The determination of the numeric average particle diameter is best performed by photon correlation spectroscopy at a wavelength of 633 nm with a 4 mW HeNe laser on a diluted sample of the pigmented inkjet ink. A suitable particle size analyzer used was a Malvern™ nano-S available from Goffin-Meyvis. A sample can, for example, be prepared by addition of one drop of ink to a cuvette containing 1.5 mL ethyl acetate and mixed until a homogenous sample was obtained. The measured particle size is the average value of 3 consecutive measurements consisting of 6 runs of 20 seconds.

Suitable white pigments are given by Table 2 in [0116] of WO 2008/074548 (AGFA GRAPHICS). The white pigment is preferably a pigment with a refractive index greater than 1.60. The white pigments may be employed singly or in combination. Preferably titanium dioxide is used as pigment with a refractive index greater than 1.60. Suitable titanium dioxide pigments are those disclosed in [0117] and in [0118] of WO 2008/074548 (AGFA GRAPHICS).

Also special colorants may be used, such as fluorescent pigments for special effects in clothing, and metallic pigments for printing a luxury look of silver and gold colours on textiles.

If the colour pigment is included in the core of the capsule, a polymeric dispersant is advantageously used for dispersion stability and handling during manufacturing of the capsules.

Suitable polymeric dispersants are copolymers of two monomers but they may contain three, four, five or even more monomers. The properties of polymeric dispersants depend on both the nature of the monomers and their distribution in the polymer. Copolymeric dispersants preferably have the following polymer compositions:

- statistically polymerized monomers (e.g. monomers A and B polymerized into ABBAABAB);
- alternating polymerized monomers (e.g. monomers A and B polymerized into ABABABAB);
- gradient (tapered) polymerized monomers (e.g. monomers A and B polymerized into AAABAABBABBB);
- block copolymers (e.g. monomers A and B polymerized into AAAAABBBBBB) wherein the block length of each of the blocks (2, 3, 4, 5 or even more) is important for the dispersion capability of the polymeric dispersant;
- graft copolymers (graft copolymers consist of a polymeric backbone with polymeric side chains attached to the backbone); and
- mixed forms of these polymers, e.g. blocky gradient copolymers.

Suitable dispersants are DISPERBYK™ dispersants available from BYK CHEMIE, JONCRYL™ dispersants available from JOHNSON POLYMERS and SOLSPERSE™ dispersants available from ZENECA. A detailed list of non-polymeric as well as some polymeric dispersants is disclosed by MC CUTCHEON. Functional Materials, North American Edition. Glen Rock, N.J.: Manufacturing Confectioner Publishing Co., 1990. p. 110-129.

The polymeric dispersant has preferably a number average molecular weight Mn between 500 and 30000, more preferably between 1500 and 10000.

The polymeric dispersant has preferably a weight average molecular weight Mw smaller than 100,000, more preferably smaller than 50,000 and most preferably smaller than 30,000.

The pigments are preferably present in the range of 0.01 to 15%, more preferably in the range of 0.05 to 10% by weight and most preferably in the range of 0.1 to 5% by weight, each based on the total weight of the inkjet ink. For white inkjet inks, the white pigment is preferably present in an amount of 3% to 40% by weight of the inkjet ink, and more preferably 5% to 35%. An amount of less than 3% by weight cannot achieve sufficient covering power.

Generally dyes exhibit a higher light fading than pigments, but cause no problems on jettability. In a preferred embodiment the dyes are disperse dyes. Disperse dyes are water insoluble dyes and are the only dyes that dye polyester and acetate fibres. Such dyes are preferred as they can easily be incorporated into the core of the capsules. A disperse dye molecule is normally based on an azobenzene or anthraquinone molecule with nitro, amine, hydroxyl, etc. groups attached to it.

Suitable examples of disperse dyes include Disperse Red 1, Disperse Orange 37, Disperse Red 55, and Disperse Blue 3. These colorants can be used as a single component, or they can be mixed with more than one colorant of the same or different types to enhance the image quality.

As disperse dyes to be used for the ink, any known disperse dye can be used, specifically including C.I. Disperse Yellow 42, 49, 76, 83, 88, 93, 99, 114, 119, 126, 160, 163, 165, 180, 183, 186, 198, 199, 200, 224 and 237, C.I. Disperse Orange 29, 30, 31, 38, 42, 44, 45, 53, 54, 55, 71, 73, 80, 86, 96, 118 and 119, C.I. Disperse Red 73, 88, 91, 92, 111, 127, 131, 143, 145, 146, 152, 153, 154, 179, 191, 192, 206, 221, 258, 283, 302, 323, 328 and 359, C.I. Disperse Violet 26, 35, 48, 56, 77 and 97, C.I. Disperse Blue 27, 54, 60, 73, 77, 79, 79:1, 87, 143, 165, 165:1, 165:2, 181, 185, 197, 225, 257, 266, 267, 281, 341, 353, 354, 358, 364, 365, and 368, and the like, and dyes suitable to satisfy required hue and fastnesses in the application can be used.

Preferably a set of inkjet inks containing disperse dyes is used, for example a CMYK inkjet ink set.

A preferred cyan inkjet ink ("C" ink) contains a disperse dye selected from the group consisting of C.I. Disperse Blue 27, C.I. Disperse Blue 60, C.I. Disperse Blue 73, C.I. Disperse Blue 77, C.I. Disperse Blue 77:1, C.I. Disperse Blue 87, C.I. Disperse Blue 257, C.I. Disperse Blue 367 and mixtures thereof.

A preferred magenta inkjet ink ("M" ink) contains a magenta disperse dye colorant selected from the group consisting of C.I. Disperse Red 55, C.I. Disperse Red 60, C.I. Disperse Red 82, C.I. Disperse Red 86, C.I. Disperse Red 86:1, C.I. Disperse Red 167:1, C.I. Disperse Red 279 and mixtures thereof.

A preferred yellow inkjet ink ("Y" ink) contains a yellow disperse dye colorant selected from the group consisting of C.I. Disperse Yellow 64, C.I. Disperse Yellow 71, C.I. Disperse Yellow 86, C.I. Disperse Yellow 114, C.I. Disperse Yellow 153, C.I. Disperse Yellow 233, C.I. Disperse Yellow 245 and mixtures thereof.

A preferred black inkjet ink ("K" ink) contains a black disperse dye or a mixture of differently coloured disperse dyes chosen such that the mixture is black in colour.

The inkjet ink set preferably contains other coloured inkjet inks, more preferably at least one inkjet ink containing a disperse dye selected form the group consisting of C.I. Disperse Violet 26, C.I. Disperse Violet 33, C.I. Disperse Violet 36, C.I. Disperse Violet 57, C.I. Disperse Orange 30, C.I. Disperse Orange 41, C.I. Disperse Orange 61 and mixtures thereof.

The pigments and/or dyes are preferably present in the range of 0.1 to 20 wt % based on the total weight of the inkjet ink.

Optothermal Converting Agents

The optothermal converting agent may be any suitable compound absorbing in the wavelength range of emission by the infrared light source.

The optothermal converting agent is preferably an infrared dye as this allows easy handling into the inkjet ink. The infrared dye may be included into the aqueous medium, but is preferably included in the core of the capsule. In the latter, the heat transfer is usually much more effective.

Suitable examples of infrared dyes include, but are not limited to, polymethyl indoliums, metal complex IR dyes, indocyanine green, polymethine dyes, croconium dyes, cyanine dyes, merocyanine dyes, squarylium dyes, chalcogenopyryloarylidene dyes, metal thiolate complex dyes, bis(chalcogenopyrilo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, (metalized) azomethine dyes and combinations thereof.

The one or more optothermal converting agents are preferably present in the range of 0.1 to 10 wt % based on the total weight of the inkjet ink.

Inkjet Printing Devices

The inkjet ink may be jetted by one or more print heads ejecting small droplets in a controlled manner through nozzles onto a substrate, which is moving relative to the print head(s).

A preferred print head for the inkjet printing system is a piezoelectric head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head. However the inkjet printing method according to the present invention is not restricted to piezoelectric inkjet printing. Other inkjet print heads can be used and include various types, such as a continuous type, a thermal print head type and a valve jet type.

The inkjet print head normally scans back and forth in a transversal direction across the moving ink-receiver surface. Often the inkjet print head does not print on the way back. Bi-directional printing, also known as multi-pass printing, is preferred for obtaining a high areal throughput. Another preferred printing method is by a "single pass printing process", which can be performed by using page wide inkjet print heads or multiple staggered inkjet print heads which cover the entire width of the ink-receiver surface. In a single pass printing process the inkjet print heads usually remain stationary and the substrate surface is transported under the inkjet print heads.

Curing Devices

The inkjet printer may contain a drying unit for removing water and organic solvents in the inkjet printed image. However, sometimes this may be combined or replaced by the curing means for curing the thermal reactive chemistry in the capsules. Alternatively, the inkjet printer may include only the drying unit for removing water and organic solvents in the inkjet printed image, while the thermal curing energy is applied afterwards, i.e. the thermal curing means is located offline.

If an optothermal converting agent is present the curing device may be a suitable light source. Preferably, the optothermal converting agent consists of one or more infrared dyes for which an infrared light source is used. Any infrared light source may be used, as long as at least part of the emitted light is suitable for activating the thermal chemistry. The infrared curing means may include an infrared laser, an infrared laser diode, infrared LEDs or a combination thereof.

An infrared light source may be connected to the print head. The source of infrared radiation may, for example, also be an elongated radiation source extending transversely across the printed image to be cured. It may be adjacent the transverse path of the print head so that the subsequent rows of images formed by the print head are passed, stepwise or continually, beneath that radiation source.

Any thermal device for curing the thermal reactive chemistry may be used or incorporated into the inkjet printer. Suitable heat radiation means include, for example, an oven, an autoclave, steaming means (e.g. a so-called "in-line steamer"), heated rollers and the like. The thermal means may also be located offline, e.g. as part of a manufacturing line for textiles, when multiple inkjet printers are used.

EXAMPLES

Measurement Methods

Surface Tension

The static surface tension of the radiation curable inks was measured with a KRÜSS tensiometer K9 from KRÜSS GmbH, Germany at 25° C. after 60 seconds.

Viscosity

The viscosity of the inkjet ink was measured using a Brookfield DV-II+ viscometer at 25° C. at 12 rotations per minute (RPM) using a CPE 40 spindle. This corresponds to a shear rate of 90 $s^{-1}$.

Materials

All materials used in the following examples were readily available from standard sources such as Sigma-Aldrich (Belgium) and Acros (Belgium) unless otherwise specified. The water used was demineralized water.

Trixene™ BI7982 was supplied by Baxenden Chemicals LTD.

Takenate™ D110N was supplied by Mitsui Chemicals Inc.;

Dye-1 has been prepared according to the following procedure:

the synthesis of the aniline:

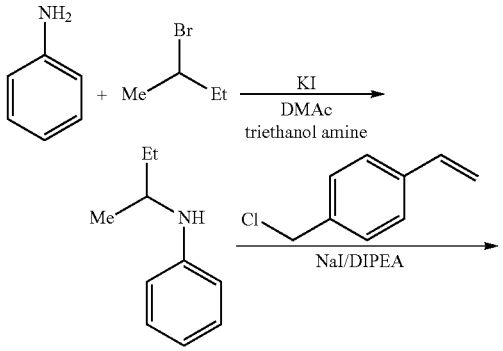

-continued

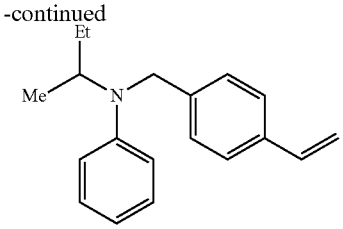

398.4 g (2.4 mol) potassium iodide was added to 400 ml dimethyl acetamide. The mixture was heated to 65° C. and 329 g (2.4 mol) 2-bromo-butane was added. The mixture was stirred at 70° C. for one hour. The mixture was heated to 78° C. and a mixture of 148.8 g (1.6 mol) aniline and 310.4 g (2.08 mol) triethanol amine was added over two hours, while keeping the temperature at 78° C. The reaction was allowed to continue for three hours at 78-80° C. 800 ml water and 200 ml ethyl acetate were added and the mixture was stirred for 15 minutes. The mixture was kept at 50° C. and the organic fraction was isolated. The organic fraction was washed twice with 400 ml water and all solvents were removed under reduced pressure at 75° C. 222 g of isobutyl aniline was isolated (y: 93%, TLC analysis on TLC Silica gel $60F_{254}$, supplied by Merck, using methylene chloride as eluent: $R_f$: 0.5). The crude isobutyl aniline was used without further purification. 36.6 g (0.24 ml) chloromethyl styrene, 30 g (0.20 mol) isobutyl aniline 32.3 g (0.25 mol) ethyl-di-isopropyl amine and 1 g (0.006 mol) potassium iodide were dissolved in 80 ml dimethyl acetamide. The mixture was heated to 100° C. and the reaction was allowed to continue for 2 hours at 100° C. The reaction mixture was allowed to cool down to room temperature and poured into 1 l water. The mixture was extracted with 200 ml methylene chloride. The organic fraction was isolated, dried over $MgSO_4$ and evaporated under reduced pressure. The crude product was purified using preparative column chromatography, on a Macherey Nagel Chromabond Flash column (MN-180 C18ec 45 μm D60 Å), using methanol as eluent. 29 g of the styrene derivatised aniline was isolated (y: 55%, TLC analysis on TLC Silica gel $60F_{254}$, supplied by Merck, using hexane as eluent: $R_f$: 0.5).

The Synthesis of Dye-1:

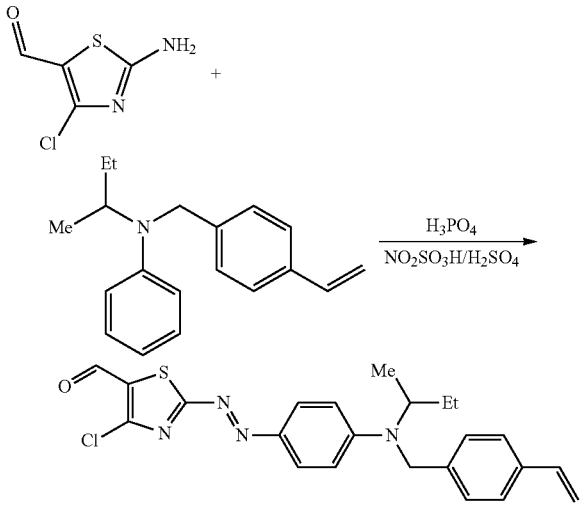

13 g (0.08 mol) 2-amino-4-chlorothiazole-5-carbaldehyde (prepared according to Masuda et al., Bioorganic and Medicinal Chemistry, 12(23), 6171-6182 (2004)) was dissolved in 100 ml phosphoric acid. The mixture was cooled to 0° C. and 20 g of 40% solution of $NO_2SO_3H$ in sulphuric acid was added, while keeping the mixture at 0° C. The reaction was allowed to continue for one hour at 0° C. This solution was added to a solution of 21.2 g (0.08 mol) of the styrene derivatised aniline in 400 ml of a 5% sulphuric acid solution in water and 150 ml methanol, while keeping the temperature at 0° C. The reaction was allowed to continue for 30 minutes at 0° C. Dye-1 was isolated by filtration and washed with a mixture of water and methanol 1/1. The crude dye was redispersed in methanol, isolated by filtration and dried. 25 g of Dye-1 was isolated (y: 71%, TLC analysis on Partisil™ KC18C, supplied by Whatman, using MeOH/0.25 M NaCl as eluent: $R_f$: 0.4).

Mackam™ 151C and Mackam™ 151L were supplied by Mcintyre Group LTD.

Lysine, glycerol, tetraethylene pentamine and triethanol amine were supplied by Aldrich.

Olfine™ E1010 was supplied by DKSH.

Pionin™ C158 dry is the 100% compound obtained after evaporation of the ethanol from Pionin-158, supplied by Takemoto Oil Fat Co. Ltd.

Dye-2 (CASRN1020729-04-7) has the following structure and can be prepared according to the methods disclosed in EP 427892 A (AGFA):

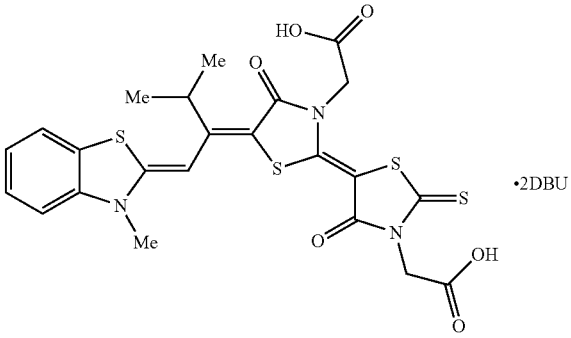

Mowiol™ 488 is a poly(vinyl alcohol) supplied by CLARIANT.

Alkanol™ XC is a surfactant (CAS 68442-09-1) from DU PONT.

Capstone™ FS3100 is a fluorosurfactant from DU PONT.

Tego Twin™ 4000 is a siloxane-based gemini surfactant from EVONIK.

Example 1

This example illustrates the encapsulation methodology wherein blocked isocyanates are encapsulated as thermally reactive chemistry into an inkjet ink.

Synthesis of Caps-1

45.8 g of Trixene™ BI7982 was evaporated at 60° C. under reduced pressure to remove 1-methoxy-2-propanol. The residue was redissolved in 29.8 g of ethyl acetate. 15 g of Takenate™ D110N and 1 g of dye-1 were added. This solution was added to a solution of 9.75 g of Mackam™ 151C, 3.25 g lysine and 0.12 g Olfine™ E1010 in 64 g water and dispersed in the aqueous phase, using an Ultra-Turrax at 18000 rpm for 5 minutes. An additional 69.18 g water was added and the pressure over the mixture was gradually reduced to 150 mm Hg over 5 minutes. The ethyl acetate was evaporated under reduced pressure (120 mm Hg) at a temperature of 50° C., followed by further reducing the pressure to 100 mm Hg. After complete evaporation of all organic solvent and 20 g water, an extra 20 g water was added and the mixture was further heated to 50° C. for 16 hours at ambient pressure. The mixture was allowed to cool down to room temperature and filtered over a 2.7 μm filter. The particle size and particle size distribution was measured using a Zetasizer™ Nano-S (Malvern Instruments, Goffin Meyvis). The capsules had an average particle size of 1.087 μm.

Preparation and Evaluation of Inkjet Ink INV-1

The dispersion Caps-1 as prepared above was used for the formulation of inkjet ink INV-1 as shown in Table 2. The weight percentage (wt %) of each component was based on the total weight of the ink.

TABLE 2

| wt % of component: | INV-1 |
|---|---|
| Caps-1 | 40 |
| Glycerol | 45 |
| Triethanol amine | 0.2 |
| Alkanol ™ XC | 0.1 |
| Water | 14.7 |

The inkjet ink INV-1 had a viscosity of 10 mPa·s and a surface tension of 30 mN/m.

The jetting performance of inkjet ink INV-1 was evaluated using a Dimatix™ DMP2831 system, equipped with a standard Dimatix™ 10 pl print head. The ink was jetted at 22° C., using a firing frequency of 5 kHz, a firing voltage of 20 V-25 V, a standard waveform and a standard cartridge setting on a glass plate. The inkjet ink INV-1 proved to be jettable with intermediate purging.

Example 2

This example illustrates the wash resistance and chemical resistance of an inkjet ink containing thermally reactive capsule jetted on cotton as textile substrate.

Synthesis of Caps-2

45.8 g of Trixene™ BI7982 was evaporated at 60° C. under reduced pressure to remove 1-methoxy-2-propanol. The residue was redissolved in 29.8 g of ethyl acetate. 15 g of Takenate™ D110N and 1 g of dye-1 were added. This solution was added to a solution of 4.85 g of Pionin™ C-158 dry, 3.25 g lysine and 0.12 g Olfine™ E1010 in 68.9 g water and dispersed in the aqueous phase, using an Ultra-Turrax at 18000 rpm for 5 minutes. An additional 68.18 g water was added and the pressure over the mixture was gradually reduced to 150 mm Hg over 5 minutes. The ethyl acetate was evaporated under reduced pressure (120 mm Hg) at a temperature of 50° C., followed by further reducing the pressure to 100 mm Hg. After complete evaporation of all organic solvent and 20 g water, an extra 20 g of water was added and the mixture was further heated to 50° C. for 16 hours at ambient pressure. The mixture was allowed to cool down to room temperature and filtered over a 2.7 μm filter. The particle size and particle size distribution was measured using a Zetasizer™ Nano-S (Malvern Instruments, Goffin Meyvis). The capsules had an average particle size of 0.968 μm.

Preparation and Evaluation of Inkjet Ink INV-2

The dispersion Caps-2 as prepared above was used for the formulation of inkjet ink INV-2 as shown in Table 3. The weight percentage (wt %) of each component was based on the total weight of the ink.

TABLE 3

| wt % of component: | INV-2 |
|---|---|
| Caps-2 | 40 |
| Glycerol | 45 |
| Triethanol amine | 0.2 |
| Alkanol ™ XC | 0.1 |
| Water | 14.7 |

The inkjet ink INV-2 had a viscosity of 10 mPa·s and a surface tension of 30 mN/m.

Wash Resistance

A solid area of inkjet ink INV-2 was printed on cotton, using a Dimatix™ DMP2831 system, equipped with a standard Dimatix™ 10 pl print head. The ink was jetted at 22° C., using a firing frequency of 5 kHz, a firing voltage of 20 V-25 V, a standard waveform and a standard cartridge setting.

The sample was cut in three parts and one part of the sample was treated in an oven at 160° C. for 5 minutes. One of the untreated samples and the thermally treated sample were washed in an aqueous solution containing 10% of a detergent mix supplied by Bielen N.V. (REF: BEL00985) at 90° C. for 10 minutes.

The three samples were compared visually. There was no visual difference between the reference sample and the thermally treated sample. The colour of the untreated sample was completely removed upon washing.

It should also be noted that encapsulation allows printing on textiles, such as cotton, which are normally not readily accessible for inkjet printing with disperse dyes.

Chemical Resistance

A second solid area was printed using the same method as described above. The samples were again cut in two parts and both parts were treated in an oven at 160° C. for 5 minutes. One sample was treated with a 5% hypochlorite solution for 10 seconds and allowed to dry. The change in colour was evaluated visually. No change in colour could be observed between the treated and untreated sample.

As reference experiment, a 1% solution of dye-1 in ethyl acetate was prepared. A cotton sample was treated with the solution and allowed to dry. The sample was cut in two parts. One of the parts was treated with a 5% hypochlorite solution for 10 seconds and allowed to dry. The change in colour was observed visually. The hypochlorite treated sample completely discolored to a yellow background stain.

This illustrates that the encapsulated dye has a much higher chemical resistance compared to the non encapsulated dye. The high chemical resistance of a textile printed with an encapsulated dye can be advantageously exploited in harsh cleaning of the textile.

Example 3

This example illustrates the synthesis having submicron average particle size, i.e. nanocapsules, and their use in inkjet printing on different polyester based textiles.

Synthesis of Caps-3

45.8 g of Trixene™ BI7982 was evaporated at 60° C. under reduced pressure to remove 1-methoxy-2-propanol. The residue was redissolved in 29.8 g of ethyl acetate. 15 g of Takenate™ D110N and 1 g of dye-1 were added. This solution was added to a solution of 4.85 g of Pionin™ C-158 dry, 3.25 g lysine and 0.12 g Olfine™ E1010 in 68.9 g water and dispersed in the aqueous phase, using an Ultra-Turrax at 24000 rpm for 5 minutes. An additional 68.18 g water was added and the pressure over the mixture was gradually reduced to 150 mm Hg over 5 minutes. The ethyl acetate was evaporated under reduced pressure (120 mm Hg) at a temperature of 50° C., followed by further reducing the pressure to 100 mm Hg. After complete evaporation of all organic solvent and 20 g water, an extra 20 g of water was added and the mixture was further heated to 50° C. for 16 hours at ambient pressure. The mixture was allowed to cool down to room temperature and filtered first over a 1.6 μm filter, followed by filtration over a 1 μm filter. The particle size and particle size distribution was measured using a Zetasizer™ Nano-S (Malvern Instruments, Goffin Meyvis). The capsules had an average particle size of 0.50 μm.

Preparation and Evaluation of Inkjet Ink INV-3:

The dispersion Caps-3 as prepared above was used for the formulation of inkjet ink INV-3 as shown in Table 4. The weight percentage (wt %) of each component was based on the total weight of the ink

TABLE 4

| wt % of component: | INV-3 |
|---|---|
| Caps-3 | 40 |
| Glycerol | 47 |
| Triethanol amine | 4 |
| Alkanol ™ XC | 1 |
| Water | 8 |

The inkjet ink INV-3 had a viscosity of 10 mPa·s and a surface tension of 33 mN/m.

A solid area of inkjet ink INV-3 was printed on different types of textiles Tex-1 to Tex-4 given in Table 5, using a Dimatix™ DMP2831 system, equipped with a standard Dimatix™ 10 pl print head. The ink was jetted at 22° C., using a firing frequency of 5 kHz, a firing voltage of 20 V-25 V, a standard waveform and a standard cartridge setting.

TABLE 5

| | |
|---|---|
| Tex-1 | AJ DISPLAY FR 320 cm × 100 m UCT76 EO N.P. from AGFA GRAPHICS |
| Tex-2 | AJ FLAG 100% polyester 200 g/m$^2$ from AGFA GRAPHICS |
| Tex-3 | Flag 6043FLBF PES-FLAGFABRIC 100% Polyester from GEORG + OTTO FRIEDRICH KG |
| Tex-4 | AJ FLAG 310 cm × 100 m UCT76 EO N.P. from AGFA GRAPHICS |

Wash Resistance

All samples were cut in three parts and one part of each sample was treated in an oven at 160° C. for 5 minutes. One of the untreated parts of each sample and the thermally treated part of each sample were washed in an aqueous solution containing 10% of a detergent mix supplied by Bielen N.V. (REF: BEL00985) at 90° C. for 10 minutes. The loss in colour density for both the treated and untreated part of each sample was evaluated visually.

TABLE 6

| Printed Sample | Untreated part | Heat treated part |
|---|---|---|
| Tex-1 | Complete loss of colour | More than 80% remaining |
| Tex-2 | Less then 5% remaining | More than 90% remaining |
| Tex-3 | Complete loss of colour | No visual loss of density |
| Tex-4 | Less then 5% remaining | No visual loss of density |

From Table 6, it can be concluded that the inkjet inks according to the present invention allow good to excellent fixation of dyes to different polyester based textiles.

The invention claimed is:

1. A method for manufacturing printed textiles comprising the steps of:

inkjet printing an image onto a textile substrate with one or more inkjet inks, wherein each of the one or more inkjet inks comprises an aqueous medium and capsules, the capsules include a polymeric shell surrounding a core, the core contains one or more thermally curable compounds including a tri- or tetrafunctional blocked isocyanate, and the polymeric shell contains a polyurea polymer, the capsules are dispersed in the aqueous medium using a dispersing group covalently bonded to the polymeric shell, the dispersing group is selected from the group consisting of a carboxylic acid or salt thereof, a sulfonic acid or salt thereof, a phosphoric acid ester or salt thereof, a phosphoric acid or salt thereof, an ammonium group, a sulfonium group, and a phosphonium group; and thermally fixing the inkjet printed image.

2. The method according to claim 1, wherein the capsules have an average particle size of no more than 4 μm as determined by dynamic laser diffraction.

3. The method according to claim 1, wherein the one or more inkjet inks includes a colorant selected from the group consisting of a pigment and a disperse dye.

4. The method according to claim 1, wherein the polymeric shell is crosslinked.

5. The method according to claim 1, wherein the one or more inkjet inks includes a thermal catalyst selected from the group consisting of a Bronsted acid, a Lewis acid, and a thermal acid generator.

6. The method according to claim 1, wherein the one or more inkjet inks includes an optothermal converting agent.

7. The method according to claim 6, wherein the optothermal converting agent comprises an infrared dye.

8. The method according to claim 1, wherein the substrate is selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles, high density polyethylene textiles, and mixtures thereof.

9. The method according to claim 2, wherein the one or more inkjet inks includes a colorant selected from the group consisting of a pigment and a disperse dye.

10. The method according to claim 2, wherein the polymeric shell is crosslinked.

11. The method according to claim 2, wherein the one or more inkjet inks includes a thermal catalyst selected from the group consisting of a Brönsted acid, a Lewis acid, and a thermal acid generator.

12. The method according to claim 2, wherein the one or more inkjet inks includes an optothermal converting agent.

13. The method according to claim 12, wherein the optothermal converting agent comprises an infrared dye.

14. The method according to claim 2, wherein the substrate is selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles, high density polyethylene textiles, and mixtures thereof.

* * * * *